US011289815B2

(12) United States Patent
Wu et al.

(10) Patent No.: US 11,289,815 B2
(45) Date of Patent: Mar. 29, 2022

(54) QUADRIFILAR HELICAL ANTENNA

(71) Applicant: HARXON CORPORATION, Guangdong (CN)

(72) Inventors: Wenping Wu, Guangdong (CN); Xiaoming Yin, Guangdong (CN); Shiwei Wu, Guangdong (CN); Jie Zhang, Guangdong (CN)

(73) Assignee: HARXON CORPORATION, Guangdong (CN)

( * ) Notice: Subject to any disclaimer, the term of this patent is extended or adjusted under 35 U.S.C. 154(b) by 129 days.

(21) Appl. No.: 16/642,009

(22) PCT Filed: Oct. 11, 2017

(86) PCT No.: PCT/CN2017/105614

§ 371 (c)(1),
(2) Date: Feb. 25, 2020

(87) PCT Pub. No.: WO2019/041451

PCT Pub. Date: Mar. 7, 2019

(65) Prior Publication Data

US 2020/0243979 A1 Jul. 30, 2020

(30) Foreign Application Priority Data

Aug. 28, 2017 (CN) ..... 201721082788.0

(51) Int. Cl.
*H01Q 11/08* (2006.01)
*H01Q 5/378* (2015.01)

(52) U.S. Cl.
CPC ..... *H01Q 11/083* (2013.01); *H01Q 5/378* (2015.01)

(58) Field of Classification Search
CPC ..... H01Q 11/08; H01Q 11/083; H01Q 11/086
See application file for complete search history.

(56) References Cited

U.S. PATENT DOCUMENTS

2003/0080904 A1 5/2003 Chen
2005/0275601 A1* 12/2005 Jostell ..... H01Q 11/08 343/895
2012/0092227 A1* 4/2012 Huynh ..... H01Q 5/371 343/859

FOREIGN PATENT DOCUMENTS

CN 203180069 9/2013
CN 205282644 6/2016
CN 106058472 10/2016

OTHER PUBLICATIONS

"International Search Report (Form PCT/ISA/210) of PCT/CN2017/105614", dated Apr. 28, 2018, with English translation thereof, pp. 1-4.

* cited by examiner

*Primary Examiner* — Daniel Munoz
(74) *Attorney, Agent, or Firm* — JCIP Global Inc.

(57) ABSTRACT

A quadrifilar helical antenna includes a conical supporting medium, a feed network, and four sets of antenna composite elements. Each set of antenna composite element includes at least one short-circuit helical arm and at least one open-circuit helical arm. The short-circuit helical arm and the open-circuit helical arm in each set of antenna composite element are sequentially wound on an outer wall of the conical supporting medium in one winding direction. In an axial direction of the conical supporting medium, a projection length of the short-circuit helical arm is greater than that of the open-circuit helical arm in each set of antenna composite element. The four sets of antenna composite elements are respectively coupled to a feeding point of the feed network for feeding, and the short-circuit helical arms in the four sets of antenna composite elements are in short-circuit connection. The antenna provided by embodiments of the present disclosure can efficiently improve the (Continued)

gain and gain bandwidth of the antenna under the condition that total occupation space is limited.

9 Claims, 3 Drawing Sheets

QUADRIFILAR HELICAL ANTENNA

BACKGROUND

Technical Field

The disclosure relates to the technical field of antennas, in particular to a quadrifilar helical antenna.

Description of Related Art

In the art of radio communication, antennas have found their extensive applications in the fields of GPS (Global Positioning System) reception and low-orbit satellite communication, including the applications in satellite-borne systems, ground stations and personal mobile communication, but frequencies generally vary in different applications. In general, in the technical field of satellite communication, many and circularly polarized working frequencies for communication are required, and thus resonant quadrifilar helical antennas are widely used.

The quadrifilar helical antenna, a circularly polarized antenna with a wide beam, has the advantages of a compact structure, strong environmental adaptability and the like, and is widely used in the art of radio communication such as low-orbit satellite communication and GPS systems. However, as a resonant antenna, the quadrifilar helical antenna has a narrow bandwidth which cannot meet the requirements of multi-system and multi-band.

SUMMARY

I. The Technical Problem to be Solved

The present disclosure is provided to solve the technical problem of a narrow bandwidth of the quadrifilar helical antenna in the prior art.

II. Technical Solution

In order to solve the technical problem above, the embodiments of the present disclosure provide a quadrifilar helical antenna, which includes a conical supporting medium, a feed network, and four sets of antenna composite elements. Each set of antenna composite element comprises at least one short-circuit helical arm and at least one open-circuit helical arm. The short-circuit helical arm and the open-circuit helical arm in each set of antenna composite element are sequentially wound on an outer wall of the conical supporting medium in one winding direction. In an axial direction of the conical supporting medium, a projection length of the short-circuit helical arm is greater than that of the open-circuit helical arm in each set of antenna composite element. The four sets of antenna composite elements are respectively coupled to a feeding point of the feed network for feeding, and the short-circuit helical arms in the four sets of antenna composite elements are in short-circuit connection.

Optionally, a cross-sectional area of one end of the conical supporting medium is smaller than that of the other end of the conical supporting medium, and transition between the two ends is smooth.

Optionally, the conical supporting medium structurally comprises: a cone, a circular truncated cone, or a circular truncated cone with one end provided with a cylinder having a matched diameter.

Optionally, the conical supporting medium structurally comprises a conical barrel, a conical pipe, or a conical pipe with one end provided with a cylindrical barrel having a matched diameter.

Optionally, free ends of any one or more of the open-circuit helical arms take a form of serpentine traces; and/or; any one or more of the short-circuit helical arms take a form of serpentine traces.

Optionally, the quadrifilar helical antenna further comprises a short-circuit metal connector; the short-circuit metal connector is disposed at an end part of any end of the conical supporting medium; and the short-circuit helical arms in the four sets of the antenna composite elements are in short-circuit connection through the short-circuit metal connector.

Optionally, the feed network is positioned at an end part of any end of the conical supporting medium.

Optionally, any one or more sets of antenna composite elements are coupled to the feeding point of the feed network by direct connection and/or ohmic connection for feeding.

Optionally, the short-circuit helical arms and the open-circuit helical arms in any one or more sets of antenna composite elements are connected by a conductive connector on which the feeding point is positioned.

Optionally, the short-circuit helical arms in any one or more sets of antenna composite elements are electrically connected to the feeding point, and the open-circuit helical arms are grounded; and/or, the open-circuit helical arms in any one or more sets of antenna composite elements are connected to the feeding point, and the short-circuit helical arms are grounded.

III. Beneficial Effects

Compared with the prior art, the technical solutions provided by the embodiments of the present disclosure have the following advantages.

According to the quadrifilar helical antenna provided by the embodiments of the present disclosure, because the supporting medium is conical, the short-circuit helical arms and the open-circuit helical arms which are wound on the outer wall of the conical supporting medium are conically enlarged or reduced while spiraling, that is, for the short-circuit helical arms and the open-circuit helical arms, the corresponding cross-sectional area perpendicular to the axis of the conical supporting medium is gradually enlarged or reduced; since the gain and the gain bandwidth of the resonant quadrifilar helical antenna are directly related to the diameter of the antenna, and the larger the diameter of the antenna is, the higher corresponding gain and gain bandwidth of the antenna are. Therefore, the antenna provided by the embodiments of the present disclosure can effectively improve the gain and the gain bandwidth of the antenna under the condition that the total occupied space is limited.

It is to be understood that both the foregoing general description and the following detailed description are exemplary and illustrative only and are not intended to limit the present disclosure.

BRIEF DESCRIPTION OF THE DRAWINGS

The accompanying drawings, which are incorporated herein and constitute a part of this description, illustrate embodiments consistent with the present disclosure and, together with the description, explains the mechanisms of the present disclosure.

In order to more clearly illustrate the embodiments of the present disclosure or the technical solutions in the prior art, the accompanying drawings required for the description of the embodiments or the prior art will be briefly described below, and it will be apparent to a person skilled in the art that other drawings may be obtained from these drawings without involving any inventive effort.

DESCRIPTION OF THE EMBODIMENTS

In order to render clearer objective, technical solutions, and advantages of the embodiments of the present disclosure, the technical solutions in the embodiments of the present disclosure will be expressly and completely described with reference to the accompanying drawings in the embodiments of the present disclosure. Obviously, the described embodiments are part of the embodiments of the present disclosure, but not all of them. On the basis of the embodiments in the present disclosure, all other embodiments obtained by a person of ordinary skill in the art without inventive efforts shall fall within the scope of the present disclosure.

Figure 1:
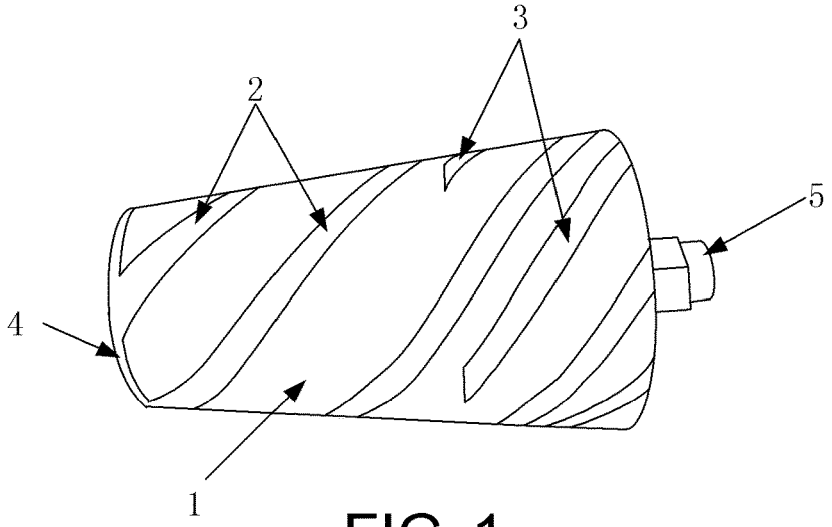
FIG. 1 is a schematic diagram of a structure of a quadrifilar helical antenna provided in an embodiment of the present disclosure.

FIG. 1 is a schematic diagram of a structure of a quadrifilar helical antenna provided in an embodiment of the present disclosure.

As shown in FIG. 1, the quadrifilar helical antenna includes a conical supporting medium 1, a feed network (not shown) and four sets of antenna composite elements. Number 5 in this figure indicates an antenna joint.

The conical supporting medium 1, made of insulating materials, can be a solid structure, or a hollow structure having a cavity inside. And when the conical supporting medium 1 is a hollow structure, the conical supporting medium can be made by rolling a flexible printed circuit (FPC).

Each set of antenna composite element includes at least one short-circuit helical arm 2 and at least one open-circuit helical arm 3. In the embodiment shown in FIG. 1, one set of antenna composite element includes one short-circuit helical arm 2 and one open-circuit helical arm 3. In other embodiments, one set of antenna composite element may comprise two short-circuit helical arms 2 and one open-circuit helical arm 3, or one short-circuit helical arm 2 and two open-circuit helical arms 3, and the present disclosure is not limited thereto.

Both the short-circuit helical arm 2 and the open-circuit helical arm 3 are metal sheets or strips. The short-circuit helical arm 2 and the open-circuit helical arm 3 in each set of antenna composite element are wound on the outer wall of the conical supporting medium 1 in one winding direction. The short-circuit helical arm 2 and the open-circuit helical arm 3 can be attached to the surface of the outer wall of the conical supporting medium 1, and can also be embedded in the outer wall of the conical supporting medium 1. Moreover, when the conical supporting medium 1 is a hollow structure having a cavity inside, the short-circuit helical arm 2 and the open-circuit helical arm 3 can also be attached to the surface of the inner wall of the hollow structure. When the conical supporting medium 1 is made by rolling a FPC, the short-circuit helical arm 2 and the open-circuit helical arm 3 may be printed circuits on the FPC.

Figure 2:
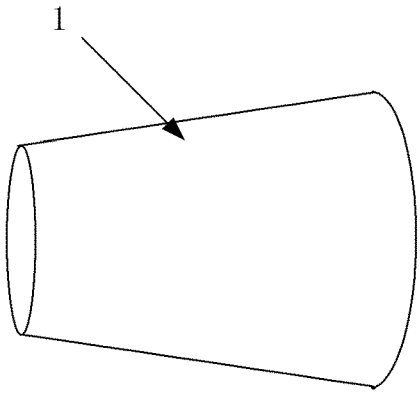
FIG. 2 is a schematic diagram of a structure of a conical supporting medium provided in an embodiment of the present disclosure.
Figure 3:
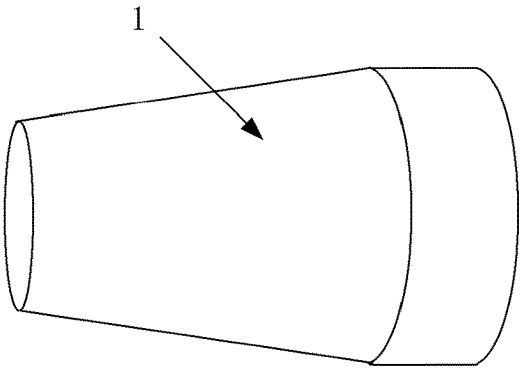
FIG. 3 is a schematic diagram of another structure of the conical supporting medium provided in an embodiment of the present disclosure.
Figure 4:
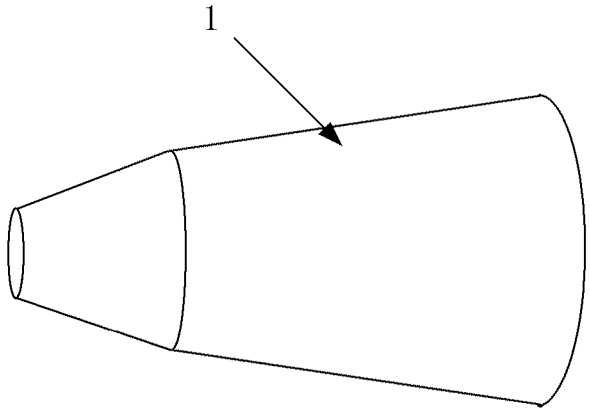
FIG. 4 is a schematic diagram of yet another structure of the conical supporting medium provided by an embodiment of the present disclosure.

In an embodiment of the present disclosure, a cross-sectional area of one end of the conical supporting medium is smaller than that of the other end of the conical supporting medium, and transition between the two ends is smooth. That is, the present disclosure does not limit the specific shape of the conical supporting medium as long as the supporting medium has a generally conical shape. For example, when a solid structure is adopted, the conical supporting medium structurally comprises a cone, a circular truncated cone (as shown in FIG. 2), or a circular truncated cone (as shown in FIG. 3) with one end provided with a cylinder having a matched diameter, or the conical supporting medium can also be two connected circular truncated cones (as shown in FIG. 4). Moreover, other structures consisting of any two or more of the cone, a truncated cone, and the circular truncated cone are all within the scope of the present disclosure. When a hollow structure is adopted, the structure of the conical supporting medium includes a conical barrel, a conical pipe, or a conical pipe with one end provided with a cylindrical barrel having a matched diameter, or the conical supporting medium can also be two connected conical pipes. Moreover, other structures consisting of any two or more of the conical barrel, the conical pipe and the cylindrical barrel are all within the scope of the present disclosure.

A gap is arranged between the short-circuit helical arm 2 and the open-circuit helical arm 3 when they are wound around the conical supporting medium 1, and the short-circuit helical arm 2 and the open-circuit helical arm 3 are arranged alternately, that is, in a rotating direction of the outer wall of the conical supporting medium 1, the short-circuit helical arm 2 is sided by the open-circuit helical arms 3, and the open-circuit helical arm 3 is sided by the short-circuit helical arms 2.

In addition, in an axial direction of the conical supporting medium, a projection length of the short-circuit helical arm 2 is greater than that of the open-circuit helical arm 3 in each set of antenna composite element. As can be seen from FIG. 1, the short-circuit helical arm 2 is connected to both end faces of the conical supporting medium, while the open-circuiting helical arm 3 is connected at only one end thereof to one end face of the conical supporting medium, with the other end freely disposed on the outer wall of the conical supporting medium. Moreover, the open-circuit helical arm 3 may be connected to either end face of the conical supporting medium.

In an embodiment of the present disclosure, widths of the short-circuit helical arm and the open-circuit helical arm in each set of antenna composite element may be the same or may be set to be different, and the present disclosure is not limited thereto. Moreover, angles at which the short-circuit helical arm and the open-circuit helical arm in each set of antenna composite element helical (i.e., the angles at which they are helically wound on the conical supporting medium)

may be the same or may be set to be different, and the present disclosure is not limited thereto.

Figure 5:
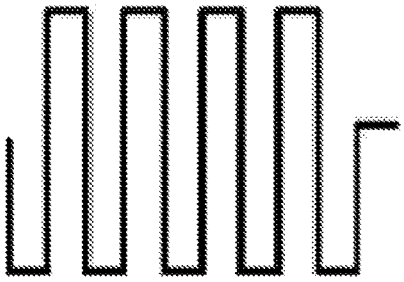
FIG. 5 shows a serpentine trace provided by an embodiment of the present disclosure.
Figure 6:
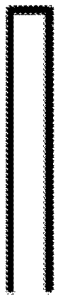
FIG. 6 shows another serpentine trace provided by an embodiment of the present disclosure.
Figure 7:
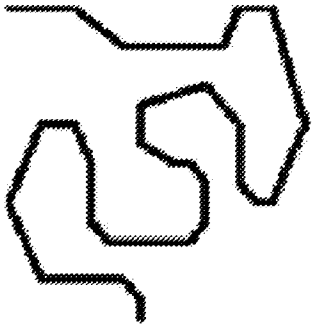
FIG. 7 shows yet another serpentine trace provided by an embodiment of the present disclosure.

In an embodiment of the present disclosure, in order to reduce the overall height of the antenna, i.e., a distance between the two end faces of the conical supporting medium, the free ends of any one or more of the open-circuit helical arms may take a form of serpentine traces, and any two of the open-circuit helical arms may take the same or different forms of serpentine traces. The particular form of the serpentine traces are not limited, as shown in FIGS. 5-7, which are schematic diagrams of three different forms of serpentine traces. By the same reasoning, any one or more short-circuit helical arms may also take the form of serpentine traces, and any two short-circuit helical arms may take the same or different forms of serpentine traces, and the present disclosure is not limited thereto.

In an embodiment of the present disclosure, the four sets of antenna composite elements are respectively coupled to a feeding point of the feed network for feeding. Moreover, feeding currents corresponding to the four sets of antenna composite elements in the feed network have continuous equiamplitude phase differences of 90°. In embodiments of the present disclosure, the feed network may be positioned at either end of the conical supporting medium, for example, the feed network may be disposed at one end of the conical supporting medium having a smaller cross-sectional area, or at the other end of the conical supporting medium having a larger cross-sectional area.

The antenna composite elements can be connected to the feeding point of the feed network either by means of simple welding and the like directly, or by means of ohmic connection (i.e., connection using an inductance-capacitance components and parts). In an embodiment of the present disclosure, when a conductive connector is used between the short-circuit helical arm and the open-circuit helical arm for connection, a feeding point between each set of antenna composite element and the feed network is positioned on the conductive connector, and the feeding point may be positioned near the short-circuit helical arm, near the open-circuit helical arm, or in a middle area between the short-circuit helical arm and the open-circuit helical arm. In another embodiment of the present disclosure, the short-circuit helical arm and the open-circuit helical arm may not be connected through the conductive connector, in which case, the short-circuit helical arm in each set of antenna composite element is electrically connected to the feeding point, and the open-circuit helical arm is grounded. Alternatively, the open-circuit helical arm in each set of antenna composite element is electrically connected to the feeding point and the short-circuit helical arm is grounded. Regardless how the antenna composite elements are connected to the feed network, the dual-frequency function of the antenna can be enabled.

In addition, the short-circuit helical arms in the four sets of antenna composite elements are in short-circuit connection. The short-circuit helical arms in the four sets of antenna composite elements can be integrally formed or connected through connectors. When the connector is used, as shown in FIG. 1, the antenna may further include a short circuit metal connector 4.

The short-circuit metal connector 4 is provided at an end part of either end of the conical supporting medium, as shown in FIG. 1, at the end of the conical supporting medium having a smaller cross-sectional area. In specific applications, the short-circuit metal connector 4 may be one or more combinations of a metal ring, a metal sheet, a cross metal sheet, and/or a metal mesh. And the short-circuit helical arm in any set of the antenna composite elements is connected with the short-circuit metal connector 4, thereby rendering a short-circuit connection among the four short-circuit helical arms.

In addition, in an embodiment of the present disclosure, a length of each short-circuit helical arm is an integer multiple of one-half wavelength, and a length of each open-circuit helical arm is an odd multiple of one-quarter wavelength. Note that the length of the helical arm here refers to the extension of the helical arm along the outer wall of the conical supporting medium, rather than the projection of the helical arm on the axis of the conical supporting medium. Moreover, if the supporting medium is loaded, the effect of the material of the supporting medium on the wavelength, i.e., equivalent wavelength, has to be considered.

According to the quadrifilar helical antenna provided by the embodiments of the present disclosure, because the supporting medium is conical, the short-circuit helical arms and the open-circuit helical arms which are wound on the outer wall of the conical supporting medium are conically enlarged or reduced while spiraling, that is, for the short-circuit helical arms and the open-circuit helical arms, the corresponding cross-sectional area perpendicular to the axis of the conical supporting medium is gradually enlarged or reduced. Since the gain and the gain bandwidth of the resonant quadrifilar helical antenna are directly related to the diameter of the antenna, and the larger the diameter of the antenna is, the higher corresponding gain and gain bandwidth of the antenna are (see Section 2, Design of Printed Quadrifilar Helical Antenna for Shipborne Maritime Satellite Communication, published in Ship Electronic Engineering, p 181, No. 2, 2010). Therefore, the antenna provided by the embodiments of the present disclosure can effectively improve the gain and the gain bandwidth of the antenna under the condition that the total occupied space is limited.

It should be noted that relational terms such as "first" and "second" are used herein merely to distinguish one entity or operation from another entity or operation without necessarily requiring or implying any such actual relationship or order between such entities or operations. Moreover, the terms "include", "comprise" or any other variation thereof are intended to indicate a non-exclusive inclusion, such that a process, method, article, or apparatus that includes a list of elements does not include only those elements but may include other elements not expressly listed or inherent to such process, method, article, or apparatus. An element defined by the phrase "including a" does not, if without more constraints, preclude the existence of additional identical elements in the process, method, article, or apparatus that includes the element.

The foregoing is merely a detailed description of the present disclosure and is presented to enable any person skilled in the art to understand or implement the present disclosure. Various modifications to these embodiments will be readily apparent to those skilled in the art, and the generic principles defined herein may be implemented in other embodiments without departing from the spirit or scope of the present disclosure. Therefore, the present disclosure is not intended to be limited to the embodiments shown herein but is to accord with the broadest scope consistent with the principles and novel features disclosed herein.

INDUSTRIAL APPLICABILITY

According to the quadrifilar helical antenna disclosed by the present disclosure, because the supporting medium is conical, the short-circuit helical arms and the open-circuit helical arms which are wound on the outer wall of the conical supporting medium are conically enlarged or reduced while spiraling, that is, for the short-circuit helical arms and the open-circuit helical arms, the corresponding cross-sectional area perpendicular to the axis of the conical supporting medium is gradually enlarged or reduced. Since the gain and the gain bandwidth of the resonant quadrifilar helical antenna are directly related to the diameter of the antenna, and the larger the diameter of the antenna is, the higher corresponding gain and gain bandwidth of the antenna are therefore, the antenna provided by the embodiments of the present disclosure can effectively improve the gain and the gain bandwidth of the antenna under the condition that the total occupied space is limited, and has great industrial applicability.

What is claimed is:

1. A quadrifilar helical antenna, comprising: a conical supporting medium, a feed network, and four sets of antenna composite elements, wherein each set of antenna composite element comprises: at least one short-circuit helical arm and at least one open-circuit helical arm, wherein the short-circuit helical arm and the open-circuit helical arm in each set of antenna composite element are sequentially wound on an outer wall of the conical supporting medium in one winding direction;

in an axial direction of the conical supporting medium, a projection length of the short-circuit helical arm is greater than that of the open-circuit helical arm in each set of antenna composite element;

the four sets of antenna composite elements are respectively coupled to a feeding point of the feed network for feeding, and the short-circuit helical arms in the four sets of antenna composite elements are in short-circuit connection; and free ends of any one or more of the open-circuit helical arms take a form of serpentine traces, and/or any one or more of the short-circuit helical arms take a form of serpentine traces.

2. The quadrifilar helical antenna of claim 1, wherein a cross-sectional area of one end of the conical supporting medium is smaller than that of the other end of the conical supporting medium, and transition between the two ends is smooth.

3. The quadrifilar helical antenna of claim 2, wherein the conical supporting medium structurally comprises: a cone, a circular truncated cone, or a circular truncated cone with one end provided with a cylinder having a matched diameter.

4. The quadrifilar helical antenna of claim 2, wherein the conical supporting medium structurally comprises: a conical barrel, a conical pipe, or a conical pipe with one end provided with a cylindrical barrel having a matched diameter.

5. The quadrifilar helical antenna of claim 1, further comprising: a short-circuit metal connector; wherein the short-circuit metal connector is disposed at an end part of any end of the conical supporting medium; and the short-circuit helical arms in the four sets of the antenna composite elements are in short-circuit connection through the short-circuit metal connector.

6. The quadrifilar helical antenna of claim 1, wherein the feed network is positioned at an end part of any end of the conical supporting medium.

7. The quadrifilar helical antenna of claim 6, wherein any one or more sets of antenna composite elements are coupled to the feeding point of the feed network by direct connection and/or ohmic connection for feeding.

8. The quadrifilar helical antenna of claim 7, wherein the short-circuit helical arms and the open-circuit helical arms in any one or more sets of antenna composite elements are connected by a conductive connector on which the feeding point is positioned.

9. The quadrifilar helical antenna of claim 7, wherein the short-circuit helical arms in any one or more sets of antenna composite elements are electrically connected to the feeding point, and the open-circuit helical arms are grounded;

and/or, the open-circuit helical anus in any one or more sets of antenna composite elements are connected to the feeding point, and the short-circuit helical arms are grounded.

* * * * *